US006162103A

United States Patent [19]

Ono

[11] Patent Number: 6,162,103

[45] Date of Patent: Dec. 19, 2000

[54] TERMINAL STRUCTURE OF A CONNECTOR

[75] Inventor: Naoyuki Ono, Tokyo, Japan

[73] Assignee: SMK Corporation, Japan

[21] Appl. No.: 09/271,722

[22] Filed: Mar. 18, 1999

[30] Foreign Application Priority Data

Mar. 18, 1998 [JP] Japan ..... 10-068207

[51] Int. Cl.[7] ..... H01R 13/24

[52] U.S. Cl. ..... 439/824; 439/733.1; 439/700

[58] Field of Search ..... 439/824, 700, 439/246, 733.1; 338/183; 277/643

[56] References Cited

U.S. PATENT DOCUMENTS 3,302,155 1/1967 Layland ..... 338/183

5,520,490 5/1996 Perach et al. ..... 411/353

*Primary Examiner*—Paula Bradley
*Assistant Examiner*—Briggitte R. Hammond
*Attorney, Agent, or Firm*—Morrison Law Firm

[57] ABSTRACT

A reflex bend in a notched elongated plate member forms a compact terminal structure of a connector without requiring soldering, caulking, or crimping. This contact connects to a connecting pin in a three point contact structure. Two contact points are made by a groove near the terminus of the connecting pin that fits into a slot in the contact. A reflex bend in the contact provides resilient force to the bottom of the connecting pin, thereby forming the third contact point. This connector structure is especially useful for small electric contact where insufficient space is available for mechanical and electrical connections.

9 Claims, 7 Drawing Sheets

TERMINAL STRUCTURE OF A CONNECTOR

BACKGROUND OF THE INVENTION

The present invention relates to the terminal structure of a connector. More specifically, the invention relates to the terminal structure of a connector for electrically connecting a contact connected to a print substrate with a connecting pin connected to an external terminal. More specifically, the invention relates to the above terminal structure without requiring the use of caulking, soldering, or the like.

Referring to FIGS. 14 to 16, pair of terminal structures is shown, each having a connector of this kind. Each terminal structure is conventionally constructed of a housing 1, a spring pin 4 and a contact 5. The housing 1 is in the shape of a box. The spring pin 4 is inserted into a through hole 1*a* formed in a central position of the housing 1. The spring pin 4 engages the through hole 1*a*. The contact 5 is fixed by caulking or crimping to a convex portion on the bottom face of the spring pin 4.

The housing 1 is constructed of a basic portion 6 and an upper stage portion 8. The basic portion 6 is located on the lower side of the housing 1 and supports a caulking portion 3 of the spring pin 4. The upper stage portion 8 is located on the upper side of the basic portion 6 and supports the upper portion of the spring pin 4.

The above spring pin 4 is inserted into the housing 1 from the bottom side of the bottom portion 2 of the basic portion 6. The spring pin 4 is engaged with the basic portion 6 in such a way that the upper portion of the spring pin 4 is projected from the top of the upper stage portion 8.

The spring pin 4 is constructed of a sleeve portion 10, a sliding terminal 11, and a spring 11*a*. The sleeve portion 10 is in an elongated cylindrical shape, having a diameter that permits inserting the sleeve portion 10 into the through hole 1*a* of the housing 1. The spring 11*a* is contained in the sleeve portion 10.

The sleeve portion 10 has an elongated cylindrical shape with an opening in its upper portion. The sleeve portion 10 has a caulking portion 3, an air hole 10*a*, and a flange portion 10*b*. The caulking portion 3 is formed at the lower end of the sleeve portion 10. The caulking portion 3 has a diameter smaller than that of the sleeve portion 10. The air hole 10*a* is formed in the lower side portion of the sleeve portion 10. The flange portion 10*b* is located in an intermediate position of the sleeve portion 10, projecting onto a circular circumference along an outside diameter of the sleeve portion 10.

The sliding terminal 11 includes a contact portion 12 and an engaging portion 12*a*. The contact portion 12 has a cylindrical portion with a diameter smaller than that of the sleeve portion 10 to permit the cylindrical portion to fit within the sleeve portion 10. The outer end of the contact portion 12 is semi-spherical. The engaging portion 12*a* has a diameter larger than that of the contact portion 12 and slightly smaller than that of the inside diameter of the sleeve portion 10. The bottom face of the engaging portion 12*a* is a contact face, contacting the spring 11*a*. The bottom face of the engaging portion 12*a* is also useful as an electric connection.

When a spring pin 4 having such a structure is assembled, the spring 11*a* is first inserted into the sleeve portion 10. The engaging portion 12*a* of the sliding terminal 11 is then inserted into the open portion of the sleeve portion 10. In this state, the engaging portion 12*a* slightly resists the biasing force of the spring 11*a*. While maintaining this state, the top of the sleeve portion 10 is crimped to a diameter smaller than the engaging portion 12*a* and slightly larger than the diameter of the contact portion 12. This maintains the engaging portion 12*a* inside the sleeve portion 10. In the spring pin 4 assembled in this way, the sliding terminal 11 is slidably moved in a longitudinal direction of the sleeve portion 10, thereby permitting it to be projected and recessed. When the sliding terminal 11 is depressed, the air within the sleeve portion 10 is discharged from the air hole 10*a*. When the sliding terminal 11 moves outward, air is drawn into the air hole 10*a* and into the sleeve portion 10. Accordingly, the spring pin 4 has a structure that permits smooth motion of the sliding terminal 11.

The contact 5 is formed in an elongated plate shape of a predetermined width, with a bend 14 at an intermediate position. A through hole 5*a* is formed in one end portion 13 of the contact 5. The through hole 5*a* has a diameter that permits inserting the caulking portion 3 therethrough, before the caulking is performed. A connecting end portion 17 is formed in another end portion 16 of the contact 5 by bending its free end in a curve.

When the housing 1, the spring pin 4 and the contact 5 are assembled, the sliding terminal 11 is first directed upward and inserted into the through hole 1*a* of the housing 1 from the bottom side. The flange portion 10*b* is press-fitted into the inner wall face of the through hole 1*a* to engage the inner wall face of the sleeve portion 10. Caulking portion 3 is not caulked or crimped at this time.

The caulking portion 3 is fitted into the through hole 5*a* of the contact 5. The contact 5 is fixed in place by crimping the projecting end of the caulking portion 3 onto the outer surface of the contact 5 around the through hole 5*a*. At this time, the bend 14 in the contact 5 is supported between supporting pieces 15 formed in the bottom portion 2 of the housing 1. The bend 14, supported by the supporting pieces 15 and the caulking portion 3, is held so that a force exerted on the other bent end portion 16 at the outer end of the contact 5 resiliently deflects the outer end of the contact 5.

However, in the terminal structure of the connector of the prior art explained above, the contact 5 is engaged with the lower end of the spring pin 4 and the caulking portion 3 by caulking. Therefore, there is a technical restriction on the size of the caulking portion 3 and the contact 5. Hence, there is a limit in the assembly of the structure of the connector. For example, there is insufficient contact area in the connector of the prior art when an attempt is made to adapt the structure to connectors having contacts in millimeter sizes.

OBJECT AND SUMMARY OF THE INVENTION

It is an object of this invention to provide for a terminal structure of a connector which overcomes the foregoing problems.

It is a further object of the invention to provide a terminal structure in which a reflex bend in a contact, and a groove in the contact provide three-point support for a contact pin.

Briefly stated, the present invention provides a reflex bend in a notched elongated plate member which forms a compact terminal structure of a connector without requiring soldering, caulking, or crimping. This contact connects to a connecting pin in a three point contact structure. Two contact points are made by a groove near the terminus of the connecting pin that fits into a slot in the contact. A reflex bend in the contact provides resilient force to the bottom of the connecting pin, thereby forming the third contact point. This connector structure is especially useful for small electric contact where insufficient space is available for mechanical and electrical connections.

According to an embodiment of the invention, there is provided a terminal structure of a connector comprising: a connecting pin, a groove portion on a diametrical outer circumference on a bottom portion of the connecting pin, a contact, the contact having a notch portion therein, the notch portion fittable over opposed sides of the groove to provide two points of supporting contact, a reflex bend in the contact, and the reflex bend resiliently positioning a portion of the contact against a lower end of the connecting pin, to provide a resilient force against a lower end of the connecting pin, and thereby to provide a third point of supporting contact to the connecting pin.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
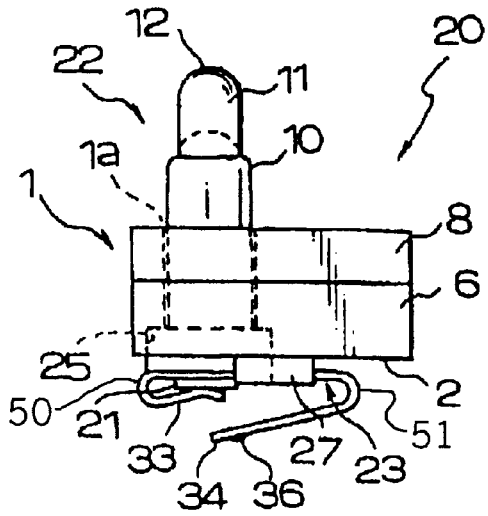
FIG. 1(A) is a front view of a connector in the present invention.
FIG. 1(B) is an enlarged cross section of the main portion of the connector showing the junction of the spring pin and the through hole of the housing.

A reflex bend 50 provides a point of contact between spring pin 22 and contact 23 by resiliently positioning a portion of contact 23 against a lower end of spring pin 22. A second reflex bend 51, in a free end portion of contact 23, provides a resilient force to the free end portion for resilient connection to a circuit.

Referring to FIGS. 1 to 4, a connector 20 of the present invention includes a housing 1, a slidable connecting pin (spring pin) 22 and a contact 23. The housing 1 is formed in a box shape and has a through hole 24 for inserting the connecting pin 22. The contact 23 is attached to a bottom side of the spring pin 22 to form an electric connection.

Referring now to FIGS. 5 to 8, the housing 1 includes a basic portion 6 and an upper stage portion 8. The basic portion 6 forms the lower side of the housing 1. The upper stage portion 8 forms the upper side of the housing 1. Two through holes 24 are formed through both the basic portion 6 and the upper stage portion 8 of the housing 1. Each of the through holes 24 includes an enlarged engaging portion 25 at its outer end, best seen in FIG. 8. The enlarged engaging portion 25 may be formed in any convenient manner such as, for example, by pressing, counterboring, etc.

A positioning piece 27 is formed on the bottom portion 2 of the basic portion 6. The positioning piece 27 is formed in a rectangular U-shape adjacent each through hole 24. In the embodiment shown with two through holes 24, the positioning piece is in the shape of an E, with the center bar of the E shared by the two through holes 24. The width of the opening of the U corresponds to the diameter of the engaging portion 25. The positioning piece 27 is formed with the sides of the U have a height greater than that of the bottom of the U. This creates a positioning piece 27 useful to position the contact 23.

Figure 9:
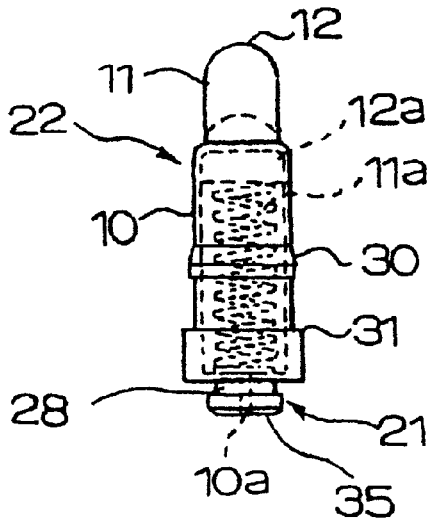
FIG. 9 is a front view of the spring pin.
Figure 10:
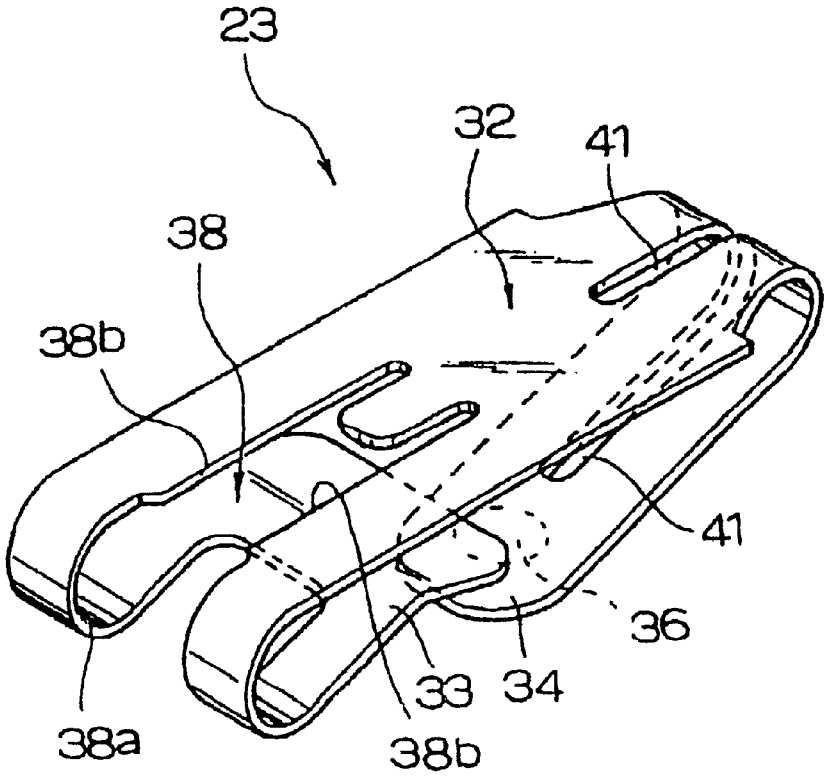
FIG. 10 is a perspective view of a contact.
Figure 11:
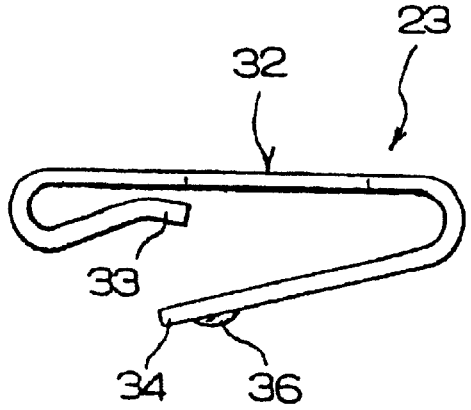
FIG. 11 is a front view of the contact.
Figure 12:
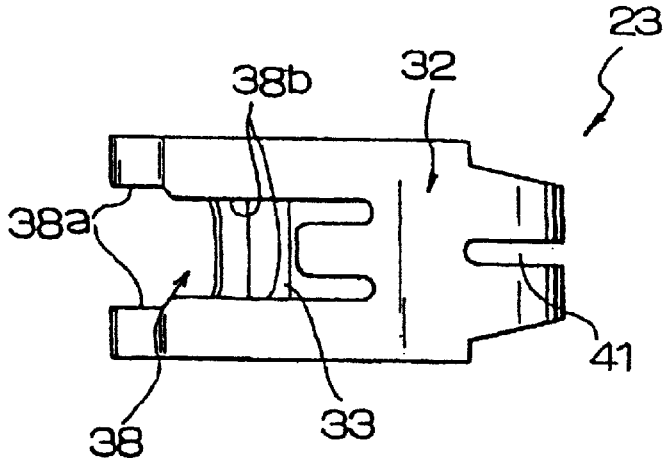
FIG. 12 is a bottom view of the contact.
Figure 13:
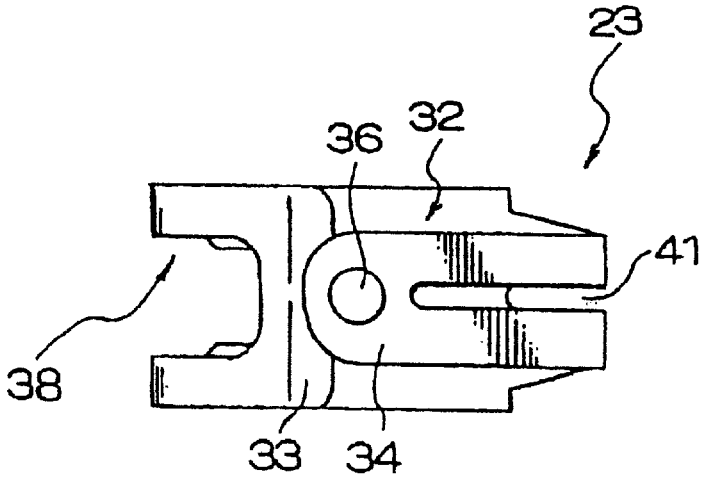
FIG. 13 is a plan view of the contact.
Figure 14:
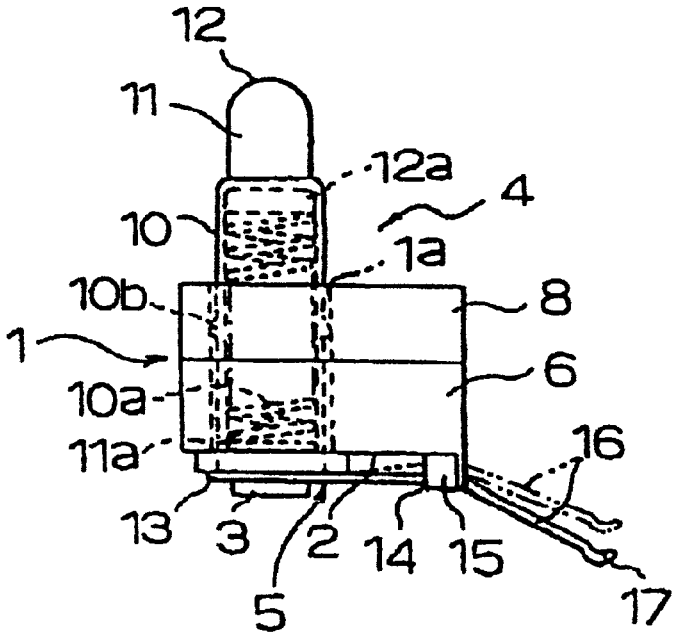
FIG. 14 PRIOR ART
FIG. 14 is a front view of a connector in the prior art.
Figure 15:
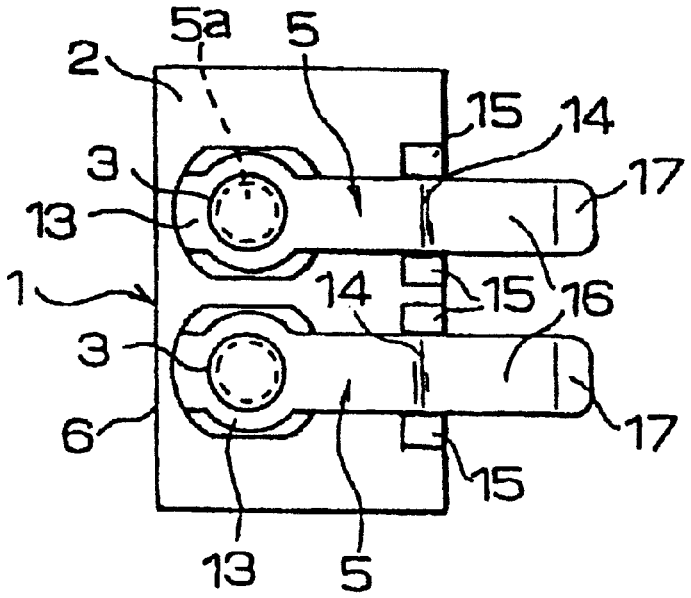
FIG. 15 PRIOR ART
FIG. 15 is a plan view of a connector in the prior art.
Figure 16:
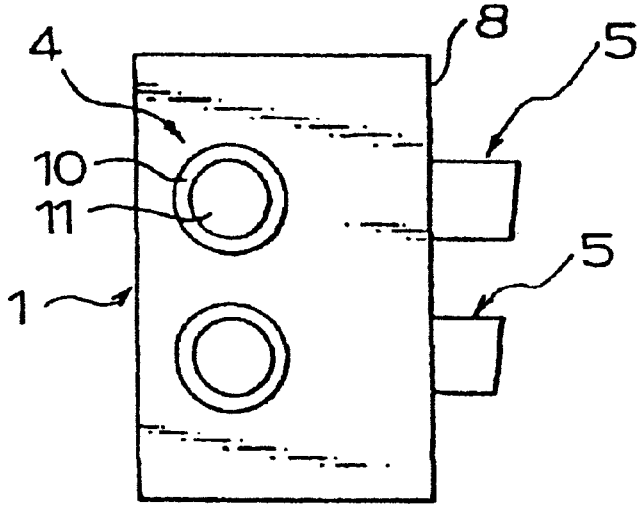
FIG. 16 PRIOR ART
FIG. 16 is a bottom view of a connector in the prior art.

Referring to FIG. 9, the spring pin 22 has a sleeve portion 10, a connecting end portion 21, a spring 11*a*, a sliding terminal 11 and an air hole 10*a*. The sleeve portion 10 has a size capable of allowing its insertion into the through hole 24 of the housing 1. The connecting end portion 21 is formed on the bottom face of the sleeve portion 10. The connecting end portion 21 has a groove portion 28 formed in a concave portion along the outer circumference of the sleeve portion 10. The spring 11*a* is contained in the sleeve portion 10. The sliding terminal 11 is cylindrical in shape. An air hole 10*a* is formed in a central position of the bottom of the sleeve portion 10. The air hole 10*a* is open between the interior and exterior of the sleeve portion 10.

A projecting strip portion 30 is an annulus formed about the sleeve portion 10. The projecting strip portion 30 projects around an outer circumferential face in an intermediate position of the sleeve portion 10. The sleeve portion 10 contacts the inner wall face of the through hole 24. The projecting strip portion 30 fixes the sleeve portion 10 to the inner wall face. Furthermore, a large diameter portion 31 is formed at a rear end of the sleeve portion 10. The large diameter portion 31 engages the engaging portion 25 at the bottom of the through hole 24 (See FIG. 8).

Referring now to FIGS. 10 to 13, the contact 23 includes a notch portion 38 formed by punching a belt-shaped notch in one of the end portions of a plate member 32. The notch portion 38 is bent in a round bend of substantial radius approximately 180 degrees. The central portion of this notch portion 38 extends in a roughly longitudinal direction. A resilient connecting portion 33 is formed at the bent free end portion of the plate member 32. A width of the notch portion 38 punched in a belt shape in its transverse direction is wider than a diameter of the groove portion 28 of the spring pin 22 described above. A bent boundary portion is made from a joining portion 38*a* for guiding the groove portion 28 of the spring pin 22. A gripping portion 38*b* at an inner end of the notch portion grips opposed edges of the groove portion 28 to guide the spring pin 22 into its installed position.

A slit 41 is formed on another end of the contact 23 by notching an elongated conductive plate member in a belt shape. A convex portion 36 is formed in the free end portion 34 at the terminal end of the slit 41. The free end portion 34 adjacent slit 41 is bent to form a curved shape bent towards the notch portion 38.

Figure 1B:
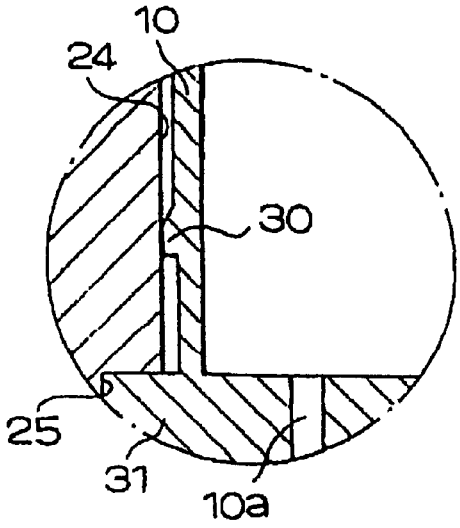
Figure 2:
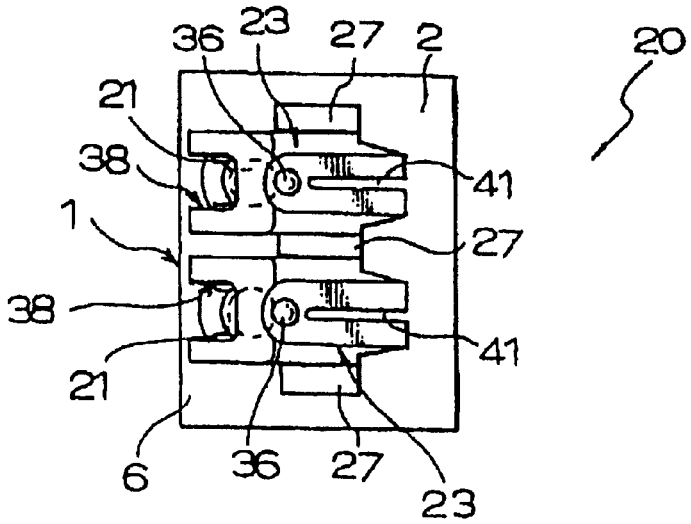
FIG. 2 is a bottom view of the connector.
Figure 3:
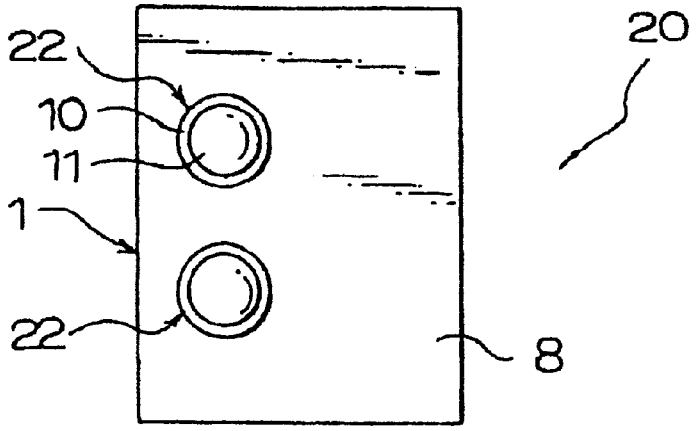
FIG. 3 is a plan view of the connector.
Figure 4:
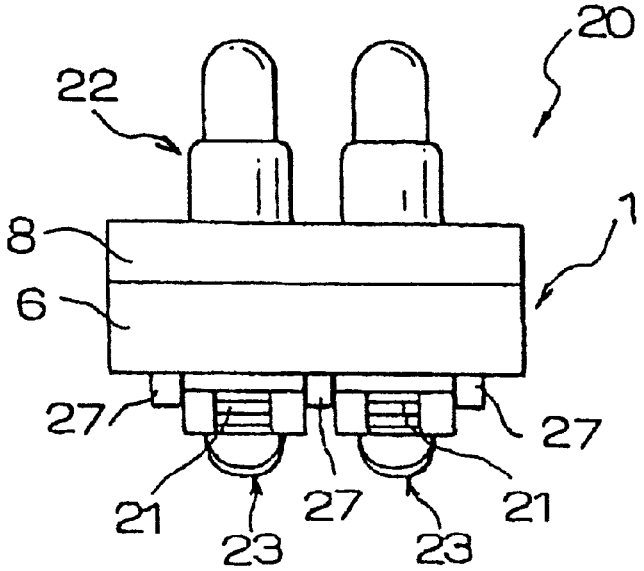
FIG. 4 is a left side view of the connector.
Figure 5:
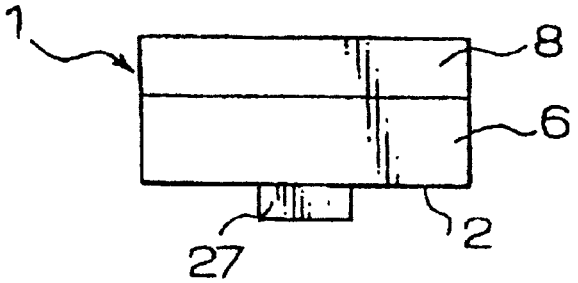
FIG. 5 is a front view of the housing.
Figure 6:
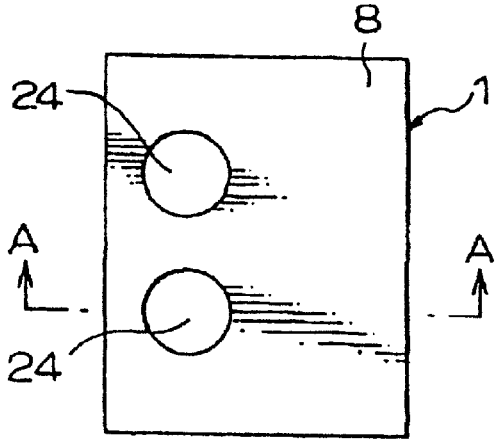
FIG. 6 is a plan view of the housing.
Figure 7:
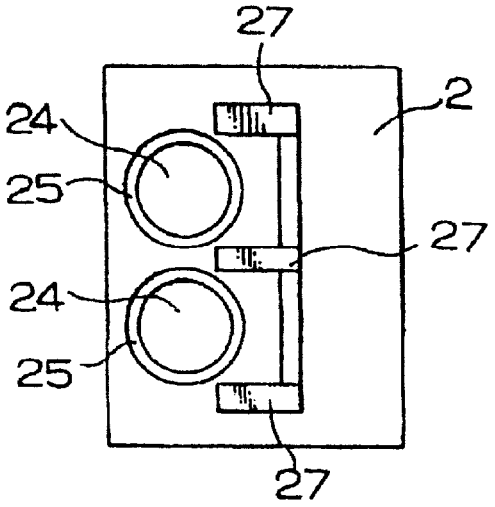
FIG. 7 is a bottom view of the housing.
Figure 8:
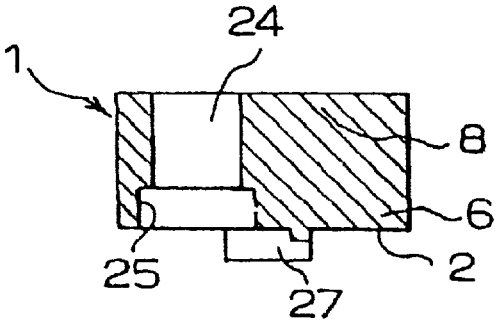
FIG. 8 is a cross section taken along line A—A of FIG. 6.

Referring now to FIG. 1(B), to assemble the housing 1, the spring pin 22 and the contact 23, the sliding terminal 11 on the end tip side of the spring pin 22 is first fitted and inserted from the bottom into the through hole 24 of the housing 1. The large diameter portion 31 is fitted into the enlarged engaging portion 25. The projecting strip portion 30 is slidably moved into engagement with the inner wall face of the through hole 24 as the projecting strip portion 30 comes in contact with this inner wall face. The sleeve portion 10, having a cavity containing the spring 11*a*, is engaged with the interior of the housing 1. No part of the sleeve portion 10 directly comes in contact with the interior of the housing 1.

Next, the joining portion 38*a* of the contact 23 comes in contact with the groove portion 28 of the spring pin 22 fixedly engaged with the through hole 24 of the housing 1. The groove portion 28 is guided in an interposing direction of the joining portion 38*a* until the groove portion 28 engages the gripping portion 38*b*. Then, the groove portion 28 is fully fitted into the contact 23 supported by the gripping portion 38*b*. Since the connecting portion 33 is resilient, the connecting portion 33 supports the groove portion 28 with a pressing force on the bottom face of the connecting end portion 21. Thus, two contact points on opposite sides of the groove portion 28 are gripped by contact with the gripping portion 38*b*. Also, the bottom face of the connecting end portion 21 is resiliently supported by force from the connecting portion 33 so that the spring pin 22 can be engaged and supported in a three-point contact structure. Therefore, the terminal structure is a very stable mechanical contact structure which also provides an electric connection. Such a contact structure can be made without requiring high accuracy in the size of the structure in the connecting position, e.g., without high accuracy in the size of the structure of the contact 23. Therefore, the structure is extremely effective in connecting compact parts to each other. For example, parts in a millimeter unit located outside of, or close to the connection limits of a caulking bit, can be connected to each other.

As explained above, the terminal structure of the connector in the present invention is engaged and held by a three-point contact structure in which the groove portion of the connecting pin is gripped on both sides of the notch portion of the contact. The bottom face of the connecting pin on its basic portion side is pressed with resilient force by the connecting portion formed by bending the notch portion. Accordingly, the present invention has the effect of providing a secure electric connection even without using caulking, soldering, or the like. A compact terminal structure for a connector is provided. The area occupied on a connected substrate can be further reduced by bending the contact on its other side to further improve the compactness of the connector device.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A terminal structure of a connector comprising:

a connecting pin;

a groove portion on a diametrical outer circumference on a bottom portion of said connecting pin;

a contact;

said contact having a notch portion therein;

said notch portion fittable over opposed sides of said groove to provide two points of supporting contact;

a reflex bend in said contact; and said reflex bend resiliently positioning a portion of said contact against a lower end of said connecting pin, to provide a resilient force against said lower end of said connecting pin, and thereby to provide a third point of supporting contact to said connecting pin.

2. The terminal structure of the connector of claim 1 wherein:

said notch portion is included along said reflex bend.

3. The terminal structure of the connector of claim 2 further comprising:

a slit formed in a free end portion of said contact;

said free end portion having a second reflex bend; and said second reflex bend providing resilient force to said free end portion of said contact for resilient connect to a circuit.

4. The terminal structure of the connector of claim 3, wherein:

said slit is included along said second reflex bend.

5. The terminal structure of the connector of claim 4 further comprising:

a housing portion;

said housing portion having a box shape, a through hole in said housing portion for inserting said connecting pin; and a positioning piece to position said contact.

6. The terminal structure of the connector of claim 5 further comprising:

a spring means in said housing; and said spring means providing a slidable movement of said connecting pin.

7. The terminal structure of the connector of claim 6 wherein:

said spring means includes a sleeve and a spring contained within said sleeve; and said sleeve formed to fit into said through hole of said housing.

8. The terminal structure of the connector of claim 7 further comprising:

an air hole in said sleeve; and said air hole allowing exchange of air between an inside of said sleeve and an exterior.

9. The terminal structure of the connector of claim 8 further comprising:

a projecting strip portion formed along an outer circumferential face in an intermediate position of said sleeve; and said projecting strip preventing directing contact between said sleeve and said housing.

* * * * *